United States Patent [19]

Rometsch et al.

[11] 4,304,172

[45] Dec. 8, 1981

[54] SETTING DEVICE FOR A HYDRAULIC MACHINE

[75] Inventors: Werner Rometsch, Gerlingen; Karl Veil, Uhingen; Georg Kehl, Stuttgart, all of Fed. Rep. of Germany

[73] Assignee: Robert Bosch GmbH, Stuttgart, Fed. Rep. of Germany

[21] Appl. No.: 126,860

[22] Filed: Feb. 28, 1980

Related U.S. Application Data

[63] Continuation of Ser. No. 899,174, Apr. 24, 1978, abandoned.

[30] Foreign Application Priority Data

May 28, 1977 [DE] Fed. Rep. of Germany ..... 2724264

[51] Int. Cl.[3] ..... F15B 9/10; F15B 13/16

[52] U.S. Cl. ..... 91/29; 91/374; 91/387

[58] Field of Search ..... 91/387, 378, 417 R, 91/374, 29, 506

[56] References Cited

U.S. PATENT DOCUMENTS 3,776,098 12/1973 Behrens ..... 91/29

3,880,050 4/1975 Rometsch ..... 91/374

FOREIGN PATENT DOCUMENTS 601866 5/1948 United Kingdom ..... 91/29

*Primary Examiner*—Paul E. Maslousky

*Attorney, Agent, or Firm*—Michael J. Striker

[57] ABSTRACT

A servo mechanism for adjusting the position of a biased control member of a sliding ring for controlling pressure fluid in a main conduit of a hydraulic machine, comprises a manually adjustable sleeve, a setting piston arranged for reciprocating movement in the sleeve and being hydraulically connected thereto to resume a position preset by the sleeve, a follower piston coupled between the setting piston and the biased control member of the recoiling device, a control pressure space provided above the follower piston, a unidirectional first control conduit delivering a regulating stream of pressure fluid from the main conduit to actuate the setting piston, a second control conduit between the main conduit and the pressure space, and a flow controlling valve controlled by pressure in the first control conduit for equalizing pressure between the pressure space and the main conduit thus allowing override of the setting piston during the pressure setting operation.

3 Claims, 1 Drawing Figure

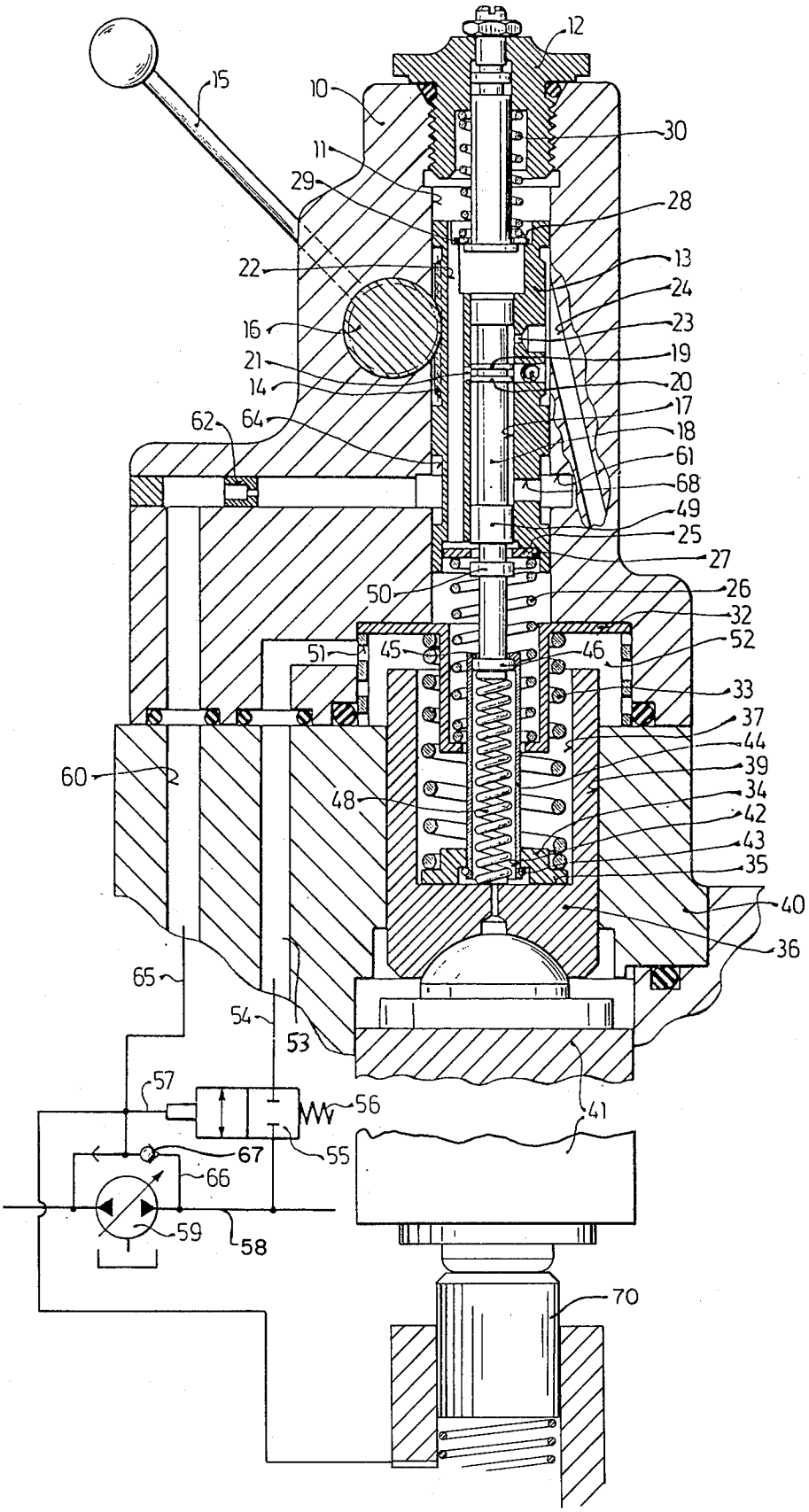
12
15
10
30
11
29
28
22
13
24
16
23
21
19
14
20
17
62
64
18
61
68
49
25
27
50
26
32
51
45
46
52
33
37
44
60
39
48
34
42
43
35
40
36
65
54
53
57
56
41
67
55
66
59
58
70

SETTING DEVICE FOR A HYDRAULIC MACHINE

This is a continuation, of application Ser. No. 899,174, filed Apr. 24, 1978, now abandoned.

BACKGROUND OF THE INVENTION

The invention relates generally to hydraulic servo systems and more particularly it relates to an adjustable servo mechanism for setting and maintaining a predetermined amount of feeding- or absorbed pressure fluid for a hydraulic machine.

Conventional servo mechanisms of this type include a manually adjustable regulating member cooperating with a setting piston to adjust a regulating stream of fluid pressure for a follower piston coupled between the setting piston and a biased control member of a recoil device for controlling the main pressure fluid in the hydraulic machine. It has been also known in prior art servomechanisms to use a flow restricting valve to relieve the fluid pressure in the hydraulic machine in response to a predetermined limit value of the fluid pressure. The disadvantage of such known arrangements however is the fact that on the completion of the pressure relief process, the nominal value of the pressure in the machine has to be reset manually.

It is therefore an object of this invention to avoid the disadvantage of the prior art servomechanisms of this type.

In particular, an object of this invention is to provide a servomechanism that upon actuation of a flow restricting valve and the subsequent misadjustment of the hydraulic machine occurring upon the completion of the flow restricting function, automatically resets the fluid pressure to its original nominal value.

Another object of this invention is to provide a servomechanism wherein the nominal value of the desired fluid pressure is adjustable manually.

Still another object of this invention is to create the improved servomechanism with minimum structural changes in existing servomechanisms of this type.

SUMMARY OF THE INVENTION

These objects, and others which will become more understandable from the description below, of an exemplary embodiment, can be met, according to this invention by providing in a hydraulic machine having a main pressure fluid conduit, a combination of a sliding ring control device coupled to the hydraulic machine and having a movable member biased for movement in one direction, a pressure setting device including a manually adjustable sleeve and a setting piston disposed for reciprocating moment in the sleeve and cooperating with a hydraulic pressure distributing conduit system to resume always the position preset by the sleeve, a follower piston coupled between the plunger and the reciprocating control member, the piston being spring biased to counteract the bias of the control member, a control pressure space provided above the follower piston, a unidirectional first conduit for delivering a regulating stream of the pressure fluid to the pressure setting device for moving the setting piston to the preset nominal position, a second control conduit for connecting the main conduit to the control pressure space, and a flow controlling valve interconnected in said second control conduit, said valve being switchable from its closed position to its open position in response to pressure changes in the hydraulic machine in order to balance through said second control conduit the pressure between said control pressure space and said main conduit.

Preferably, a two-position, two-port flow restricting valve is used in its normally closed position interrupting the second control conduit and is brought to its open position in response to pressure changes in the first control conduit. To achieve override of the flow piston with respect to the setting piston, a tubular member is coaxially arranged in the control pressure space between the setting piston and the follower piston. The tubular member at one end thereof is suspended to a flange on the lower end of the setting piston and at the other end thereof it rests on a spring plate and is biased against the follower piston by a relatively strong spiral pressure spring. In addition a weaker pressure spring passes through the tubular member and resiliently connects the setting piston to the follower piston. In this manner the downward movement of the follower piston is executed by the strongest spring whereas the weaker spring contributes to the upward movement of the setting piston.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

BRIEF DESCRIPTION OF THE DRAWING

The single FIGURE is a sectional side view and partly schematical view of the hydraulic servomechanism according to this invention.

DESCRIPTION OF THE PREFERRED EMBODIMENT

The adjustable servomechanism has a block housing 10 with a longitudinal bore 11 passing through and communicating with a coaxial boring 39 of increased diameter provided in an adjacent housing block 40 of a control device 70 for controlling via an upwardly biased sliding- or upstroke ring 41 the fluid pressure in a hydraulic machine 59, such as a reversible pump. Pressure fluid is fed from the pump 59 into a main conduit 58. An axially movable sleeve 13 is arranged within the bore 11 and is in slidable contact with the inner walls of the housing 10. A rack and pinion drive 14 and 16 is provided between the sleeve 13 and the housing block 10; the pinion 16 of the rack and pinion drive is rotated by means of a manual control lever 15 so that the axial position of the sleeve 13 within the bore 11 can be preset manually. The interior of the sleeve 13 defines a central passage 17 in which a setting piston 18 is axially movable, and a lateral passage 22 extends through the entire length of the sleeve 13 parallel to the central passage 17. The setting piston 18 is provided with end flanges 49 being in slidable contact with the inner walls of the central passage 17 and in addition a pair of spaced intermediate flanges 19 and 20 define an annular space around a relatively short stem portion of the setting piston 18. This annular space cooperates with a nozzle 21 between the open passage 22 and the central passage 17. A throttle opening 23 is provided opposite to and above the transverse nozzle 21 and communicates with a channel 24 in the housing block 10. The channel 24 leads to the hydromachine 59 which may be a radial vane pump as described for example, in the U.S. Pat. No. 3,959,969.

The bottom portion of the setting sleeve 13 is terminated with a spring collar 27 abutting against an inner shoulder or inner step 25 at the end portion of the sleeve 13 and lying on a pressure spring 26. Accordingly, when the control sleeve 13 is moved downwardly by means of the lever 15, it acts against the pressure spring 26. A similar pressure spring 30 is arranged between the lid 12 and a spring collar 29 lying on a top shoulder 28 of the sleeve 13. This spring 30 is compressed only if the adjustment sleeve 13 is moved by the manual lever 15 to its uppermost position.

The lower pressure spring 26 is supported on a cup-shaped spring support 32 that projects into the increased bore 39 in housing block 40. A cup shaped follower piston 36 is movably arranged in the boring 39 and in slidable contact with the walls of the housing 40. The bottom of the blank recess 37 in the follower piston 36 supports a stepped annular spring collar 34. A relatively strong pressure coil spring 33 is supported on the spring collar 34 and is urged at its other end against the outer surface of the spring support 32. The blank recess 37 in the follower piston 36 and the increased area below the spring support 32 forms a control pressure chamber or space 52. The follower piston 36 is supported on an axially movable sliding ring 41 that controls the stroke of the hydraulic machine. The spring collar 34 has a stepped central opening 42 through which passes a tubular member 44 connected to the spring collar 34 by means of a snap ring 43. The upper end of the tubular member 44 has an inwardly directed shoulder 45 that comes into engagement with the upper surface of a flange 46 provided on the lower end of the setting piston 18. A pressure spring 48 that is relatively weaker than the pressure spring 33, is arranged in the tubular member 44 between the end 46 of the setting piston and the bottom of the recess 37 in the follower piston 36. The aforementioned spring collar 27 surrounds the stem of the setting piston 18 between the flanges 49 and 50.

A channel 53 passes through housing box 10 and 40 and connects through an aperture 51 in the spring support 32 the control pressure space 52 created in the extended lower part of the bore 17 below the spring support 32 with the conduit 58 feeding pressure fluid from a hydraulic machine 59 such as a reversible pump, for example.

Connection is effected via a conduit 54 and a two-position two-port fluid restricting valve 55 that is normally in its closed position and controlled by an increased pressure in the main conduit 58 through a conduit 66, reverse flow check valve 67 and a conduit 57 to resume an open or flow-through position.

The check valve 67 is further connected through conduit branch 65 with a second channel 60 passing through the housing blocks 40 and 10 to direct a control stream of the pressure fluid from the conduit 58 through a choke member 62 into an annular groove 61 made in the housing block 10 around a part of the axial bore 11. An axially extended annular groove 64 is created in the control sleeve 13 opposite the annular groove 61 and a transverse channel 68 connects the resulting annular passages 61 and 64 with the annular space about the stem portion of the setting piston 18 in the central passage 13 of the sleeve 17.

Upon changing the axial position of the control sleeve 13 by means of the manual lever 15, the transverse nozzle 21 in the sleeve 13 changes its position relative to the flanges 19 and 20, on the setting piston 18 in such a manner that the control stream of pressure fluid from the channel 62 is admitted into the pressure space 52 via the annular passage between the grooves 61 and 64, the nozzle 21 and the open passage 22 or the pressure fluid in the space 52 is discharged. If the pressure in the space 52 is increased, the follower piston 36 moves downwardly and diminishes the upstroke of the ring 41 of the recoiling device. This process takes place so long until the flanges 19 and 20 on the setting piston 18 resume their initial position with respect to the transverse nozzle 21. The follower piston 36 moves therefore in the same sense as the setting of the control sleeve 13.

The pressure relief in the space 52 is effected through the transverse bore 23 and the channel 24. As soon as the pressure in space 52 is released, the follower piston 36 starts moving upwardly due to the action of the lifting ring 41 connected to a piston of a recoil device. The above described operation of the servomechanism is known from prior art and therefore has been described only briefly.

According to this invention it is now possible to overdrive the position of the follower piston 36 relative to a nominal position preset in the servomechanism. This overdriving is made possible by the application of the aforementioned flow controlling valve 55 between the pressure fluid conduit 58 and the conduit 54 communicating through the passage 53 with the pressure space 52. The flow control valve 55 in this example is a two-ported valve normally biased by a spring 56 in its closed position and controlled by increased pressure in the conduit flange 57 to take its open position. For example, if an increased pressure takes place in the main pressure fluid conduit 58, the valve 55 becomes opened and the pressure fluid is admitted through the conduit 54 and the channel 51 into the pressure space 52. As a consequence, even if the two flanges 19 and 20 shut off the transverse nozzle 21, the follower piston 36 starts moving downwardly. Because of the fact that the spring plate 34 is positively coupled to the central tubular member 44 by the snap ring 43, and the pressure spring 33 urges the spring plate 34 against the bottom of the recess in the follower piston 36 the downward movement of the follower piston 36 is transmitted to the setting piston 18 and the flanges 19 and 20 are shifted downwardly out of alignment with the transverse nozzle 21. Normally, the pressure in the pressure space 52 would become quickly relieved through the open passage 22 and the upper transverse nozzle 23 so that the servomechanism might reverse its downward movement and induce the movement of the setting and follower pistons 18 and 36 upwardly. This instant pressure-relieving action in the embodiment of this invention is no longer possible due to the choke 23 in the transverse nozzle since more pressure fluid is fed through the channel 53 into the pressure space 52 than can be discharged through the throttle or choke opening 23. The pressure spring 33 is stronger than the pressure spring 48 and consequently the setting piston 18 is always attracted by the follower piston 36. Only upon the closing of the flow valve 55, the pressure fluid from the space 52 is permitted to escape through the choke passage 23 so that the follower piston 36 starts moving upwardly. The pressure spring 48 therefore urges the setting piston 18 in the upward direction until the transverse nozzle 21 is covered by the flanges 19 and 20 and the nominal pressure value corresponding to that before the intervention of the flow valve 55 is reinstated.

Since in the closed position of the valve 55 the pressure in the space 52 is relieved and the follower piston 36 moves upwardly, the pressure spring 48 continues moving the setting piston 18 in upward direction until the transverse nozzle 21 is again out of alignment with the lower flange 20. The servomechanism starts counteracting this upward movement by feeding the control stream of pressure fluid through the channel 60 into the pressure space 52. This counteraction however is impeded by the choke 62 in the channel 60 since more pressure fluid flows away from the space 52 through the channel 53 than is admitted through the choke 62. If the flow restricting action of the valve 55 is terminated, no pressure fluid can be discharged from the pressure space 52 and the control stream of pressure fluid flowing into the space 52 through the channel 60 and the choke 62 closes through the servo-control of the follower piston 36 the setting piston 18 to move into its nominal position preset by the lever 15. Flanges 19 and 20 in this nominal position have again interrupted the connection of the transverse nozzle 21 to the bore 17 and the pressure spring 48 can no longer exert axial movement on the setting piston 18.

In the above described manner, a simpler and unexpensive pressure balancing means is attained between the inlet and outlet conduits. The separate adjustment of the equalizing inlet and outlet conduits for the upward movement of the pistons is attained by the provision of the tubular member 44 and the piston spring 48 whereas for the downward movement it is attained by the pressure spring 33. The servomechanism performs its controlling function under the load of minute spring forces since the tubular member 44 decouples the pressure spring 33 from the setting piston 18. In addition, the mechanism of this invention is resistant against impurities and corrosion.

While the invention has been illustrated and described as embodied in a specific example of the servomechanism for hydraulic machines, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitutes essential characteristics of the generic or specific aspects of this invention

What is claimed as new and desired to be protected by Letters Patent is set forth in the appended claims.

1. An adjustable servomechanism for a hydraulic machine having a main pressure fluid conduit, and a control device including a sliding ring, comprising in combination, a housing block defining a bore and a pressure space communicating with said bore; a manually adjustable hollow control member disposed for reciprocating movement in said bore; a follower piston disposed for reciprocating movement in said pressure space; said sliding ring urging said follower piston into said bore; pressure distributing means including a setting piston arranged for reciprocating movement in said control member and a pressure spring arranged in contact with said setting piston and adapted for transmitting the movement of said follower piston toward said setting piston; pressure inlet means coupled between the main conduit and the interior of said control member to deliver a stream of control pressure fluid to said pressure distributing means, said control pressure fluid being distributed by said setting piston to adjust the position of said follower piston in response to a preset position of said manually adjustable control member; and a conduit including a flow control valve and connected between said pressure control space and said main conduit, said valve being controlled by said inlet stream of control pressure fluid.

2. A servomechanism as defined in claim 1, further comprising a tubular member surrounding the pressure spring and being slidably coupled to the setting piston.

3. A servomechanism as defined in claim 2 wherein said tubular member is coupled to a spring plate supporting a second pressure spring that is stronger than said first mentioned pressure spring and urges said follower piston in the direction away from said setting piston.

* * * * *